US010525732B2

(12) United States Patent
Slomianny

(10) Patent No.: US 10,525,732 B2
(45) Date of Patent: Jan. 7, 2020

(54) INK JET PRINTER FOR THE LABELLING OF GOODS WITH A WRITE HEAD AND A SUPPLY TANK

(71) Applicant: EBS Ink Jet Systeme GmbH, Nümbrecht (DE)

(72) Inventor: Andreas Slomianny, Nuembrecht (DE)

(73) Assignee: EBS Ink Jet Systeme GmbH, Nümbrecht (DE)

( * ) Notice: Subject to any disclaimer, the term of this patent is extended or adjusted under 35 U.S.C. 154(b) by 0 days.

(21) Appl. No.: 16/092,000

(22) PCT Filed: Apr. 6, 2017

(86) PCT No.: PCT/EP2017/058221
§ 371 (c)(1),
(2) Date: Oct. 8, 2018

(87) PCT Pub. No.: WO2017/174708
PCT Pub. Date: Oct. 12, 2017

(65) Prior Publication Data

US 2019/0111707 A1 Apr. 18, 2019

(30) Foreign Application Priority Data

Apr. 6, 2016 (DE) ..... 10 2016 106 259

(51) Int. Cl.
*B41J 3/36* (2006.01)
*B41J 2/175* (2006.01)
*B41J 3/407* (2006.01)

(52) U.S. Cl.
CPC ..... *B41J 3/36* (2013.01); *B41J 2/17556* (2013.01); *B41J 2/17566* (2013.01); *B41J 3/4075* (2013.01)

(58) Field of Classification Search
CPC ... B41J 3/36; B41J 3/4075; B41J 2/175; B41J 2/17556; B41J 2/17566
See application file for complete search history.

(56) References Cited

U.S. PATENT DOCUMENTS 6,290,343 B1 9/2001 Lewis et al.
2007/0013752 A1* 1/2007 Wilson ..... B41J 2/17509 347/85

(Continued)

FOREIGN PATENT DOCUMENTS

DE 19812480 9/1999
WO WO 2013/120702 8/2013
WO WO 2015/119594 8/2015

OTHER PUBLICATIONS

Internationaler Recherchenbericht und Schriftlicher Bescheid [International Search Report and the Written Opinion] dated Jul. 11, 2017 From the Internationalen Recherchenbehörde [International Searching Authority Re. Application No. PCT/EP2017/058221 and Its Translation of Search Report Into English. (12 Pages).

*Primary Examiner* — Henok D Legesse

(57) ABSTRACT

The ink jet printer for the labelling of goods has a write head, which comprises at least one outlet opening for ink droplets, a printing mechanism connected to said outlet opening, a pneumatic pump and an electrical control. It has at least one supply tank for fluid flowing through the outlet opening. The supply tank is releasably connected to the write head in a coupling area. In the write head, a first pressure sensor is arranged at the compressed-air line, which detects the air pressure in the compressed-air line and outputs an air pressure signal to the controller. A second pressure sensor is arranged at the ink line, which detects the pressure in the ink line and outputs an ink pressure signal to the controller. Said (Continued)

controller outputs a signal "ink empty", if the ink pressure signal declines by more than 10% in relation to the air pressure signal.

8 Claims, 3 Drawing Sheets

(56) References Cited

U.S. PATENT DOCUMENTS

| | | | | |
|---|---|---|---|---|
| 2015/0015644 | A1* | 1/2015 | Slomianny | B41J 2/17513 347/86 |
| 2015/0197096 | A1 | 7/2015 | Yamakawa | |
| 2017/0008297 | A1* | 1/2017 | Angulo Navarro | B41J 2/175 |

* cited by examiner

INK JET PRINTER FOR THE LABELLING OF GOODS WITH A WRITE HEAD AND A SUPPLY TANK

RELATED APPLICATIONS

This application is a National Phase of PTC Patent Application No. PCT/EP2017/058221 having International filing date of Apr. 6, 2017, which claims the benefit of priority of German Patent Application No. 10 2016 106 259.6 filed on Apr. 6, 2016. The contents of the above applications are all incorporated by reference as if fully set forth herein in their entirety.

FIELD AND BACKGROUND OF THE INVENTION

An ink jet printer for the labelling of goods with a write head, comprising a) at least one outlet opening for ink droplets at a frontal surface, b) a mechanism connected to the outlet opening, c) a pneumatic pump and d) an electrical control, and having at least one supply tank for fluid flowing through the outlet opening, such as e.g. ink, pigment or solvent, wherein the supply tank is releasably connected to the write head in a coupling area, and comprising a housing as well as a foldable bag residing in said housing, in which bag the fluid is accommodated and which is connected to the printing mechanism via an ink line, which is passed across the coupling area, the pneumatic pump is connected to the space between the housing and the bag via a compressed-air line and thus pressurizing said space with overpressure.

The invention preferably relates to such ink jet printers in the form of hand-held devices, see e.g. WO2013/120702 A1, it may also be utilized with stationary devices, see e.g. EP 1 064 153 B1. Hand-held devices are self-contained, they are provided with a voltage supply source, especially an accumulator, for example, like cordless screwdrivers. With stationary devices, voltage supply generally is done from the outside, e.g. via the regular electrical grid.

The fluid required for the printing procedure is in the supply tank. For this purpose, reference is made to WO 2013/120702A1, the disclosure of which is fully incorporated into the disclosure of the present application and in this respect is included therein. In practical operation, the supply tank is required to be quite frequently replaced, as the fluid, while being pressurized, is constantly consumed, thus depleting the supply after a certain number of pressurizing cycles. Therefore, the supply tank is formed such that it may easily be replaced. It may be released from the write head at the coupling area. When decoupling, the ink line and the compressed-air connection will be interrupted.

A supply tank having an internal bag, which receives the fluid, and a compressed-air space located between the bag and the housing of the supply tank have the advantage that hydraulic pressure required for the pressurizing procedure is or may be achieved by way of pneumatic pressure, respectively. The fluid usually does not pass through an additional pressure hydraulic pump, in which deposits etc. may be formed.

The disadvantage with the previously-known ink jet printer resides in that, as the ink supply in the bag runs short, the print image deteriorates. There is a lack of simple evidence that the ink supply is running short. It is thus desired to provide an ink emptiness signal at the appropriate time.

SUMMARY OF THE INVENTION

This will be addressed by the invention. The object of the invention is to further develop the ink jet printer of the above-mentioned type in which an ink emptiness signal may be generated. This is to be performed by the use of simple means. The emptiness signal preferably is to be output prior to deterioration of the print image.

In view of this, the invention solves the issue starting from the features of the Preamble of the claim 1 in that a first pressure sensor is associated to the write head of the compressed-air line, which detects the air pressure in the compressed-air line and supplies an air pressure signal to the controller, in that a second pressure sensor is associated to the ink line in the write head, which therein detects the pressure in the ink line and supplies an ink pressure signal to the controller, and in that the controller outputs a signal "ink empty", when the ink pressure signal declines by more than 3%, preferably more than 5% in relation to the air pressure signal.

The invention suggest to detect both the pressure generated by the pneumatic pump and said pressure generated therein and provided in the ink line and to compare them to each other. At that point, the starting signal is the ratio of the two pressure values, which is the one during regular operation, when sufficient ink is available. During normal operation, the air pressure in the compressed-air line is slightly higher than fluid pressure in the ink line, as a small fraction of the air pressure is used to fold the bag, etc. During normal operation, the ratio of the air pressure signal and ink pressure signal will be determined and is recorded as a base value. If the ink pressure signal declines, it means that the ink supply is running short. At that point, as emptying of the bag increases, more and more air pressure energy will be required to fold the bag, which results in loss of ink pressure. Particularly, the pressure in the ink line decreases so that the bag will essentially be squeezed out. The invention has the advantage that a signal of emptiness "ink empty" may already be output prior to deterioration of the print image.

It is advantageous to monitor the air pressure signal independently of the ink pressure signal so that air pressure is always sufficient, especially, that the air pressure signal is essentially constant. Thus, for example, defective supply of compressed-air may also be detected. Erroneously displayed values may be avoided.

One can measure the air pressure starting from its generation in the pneumatic pump to the location, where the compressed-air line passes through the coupling area. Determining air pressures in the pneumatic pump itself involves effort, unless the pneumatic pump provides for such determination. It is thus of advantage, to measure between the pneumatic pump and the location, where the compressed-air line passes through the coupling area. Measurement is done where the compressed-air line may smoothly be accessed.

In practical embodiment, the compressed-air line terminates in the coupling area. The coupling area has an externally located gasket. In this way, separate single coupling of the compressed-air line will not be required. An outer surface of the supply tank limits the compressed-air space of the supply tank. With a supply tank that is not connected to a write head, the space between the air-tight housing and the bag is open towards the outside.

The invention has the advantage, that all actions required for measuring may be performed in the write head. All sensors are located in the write head. No interventions into the supply tank are required. The supply tank may continue to be used as it is known from prior art.

As sensors for the determination of the pressures, commonly used commercially available sensors may be used, for example piezo elements, pressure gauges and the like.

The extent, by which the ink pressure signal is required to decline in relation to the air pressure signal, until signaling "ink empty", is variable and may be adapted and selected depending on the stiffness of the bag, the size of the pressurized spaces etc., respectively. It depends on the controller, within which time span the signal will actually be output following first-time-decline of the ink pressure signal. It absolutely is within the scope of the invention that an average value will be taken across a certain duration of time, until the signal "ink empty" will be output, for example a few seconds. In this way, short-term events, caused by any interferences, may be excluded.

It is advantageous that in the controller the emptiness signal "ink empty" will not be output, before the ink pressure signal has declined in relation to the air pressure signal during a span of time of greater than zero, especially, at least 0.5 to 3 seconds.

It is possible, to combine individual coupling means to each other, e.g. the mechanical coupling and the fluid coupling, and to merge them into a single coupling.

BRIEF DESCRIPTION OF THE SEVERAL VIEWS OF THE DRAWINGS

Further advantages and features of the invention will arise from the remaining claims as well as description below of two working examples of the invention, which are to be understood as being non-limiting, which in the following will be explained in detail by making reference to the drawings, wherein:

DESCRIPTION OF SPECIFIC EMBODIMENTS OF THE INVENTION

Figure 1:
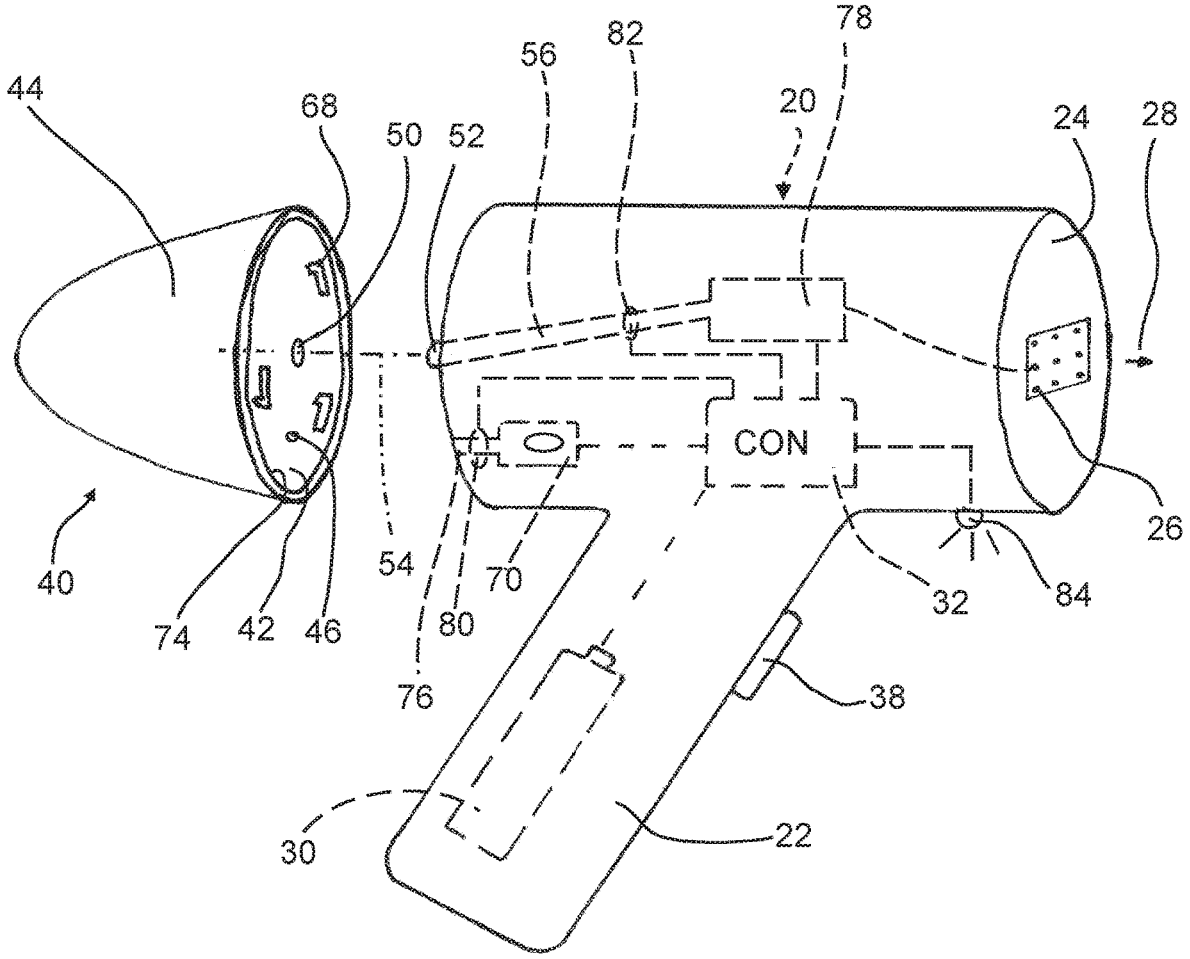
FIG. 1: is a perspective representation of an ink jet printer as an assembly picture with a main frame and a supply tank spaced apart therefrom.

According to the two working examples, the ink jet printer for the labelling of goods is designed as a hand-held device. It comprises a main unit 20, which herein essentially is cylindrically formed having an attached handle 22. In FIG. 1, a frontal surface 24 is located at the right hand side of the main unit 20, where several ink 49 outlet openings 26 are provided. Discharge of ink is according to the arrow 28. Printing is preferably done with ink droplets. In the handle 22, a voltage supply 30 is accommodated, as represented as an accumulator. It is connected with a controller CON 32, which controls the overall operational procedure. In the handle 22, a release button 38 is mounted, through which a pressurizing procedure will be initiated.

In FIG. 1, on the left hand side adjacent to the main unit 20 a supply tank 40 is located, separated by a parting plane. It has its own housing. It is limited by a planar container wall 42, which has the shape of a disc, and by an air-tight cap 44. Both are joined air-tightly to each other. The interior space limited thereof is in communication with the outside via a hole. The hole 46 is located in the container wall 42.

Figure 5:
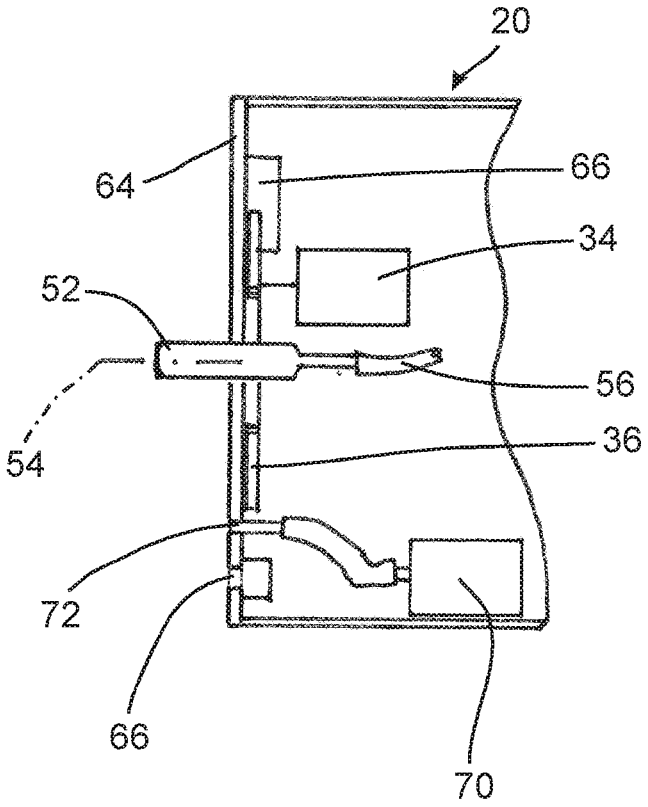

A bag 48 for ink 49 is located in the interior space of the supply tank 40. It is made of a foldable, thin material, for example plastic film. Its interior volume varies depending on the charge of ink 49, it is only filled with fluid, e.g. ink 49, and is connected to the outside environment solely via a second coupling member 50. This second coupling member 50 is designed as a socket and cooperates with a first coupling member 52, which transversally protrudes to the parting plane at the main unit 20 and is formed as a connector. The two coupling members 50, 52, in the joint state, allow fluid-tight connection. The two coupling members 50, 52 are rotationally symmetrical to an axis 54. As it is shown in FIGS. 1 and 5, the first coupling member 52, within the main unit 20, is coupled to an ink line 56, which herein is formed as ink tubing. In this way, the interior space of the bag 48 exclusively is accessible, if the two coupling members 50, 52 are connected to each other. The two coupling members 50, 52 and the ink line 56 form an ink supply line, which is disrupted when decoupling the coupling area.

Figure 4:
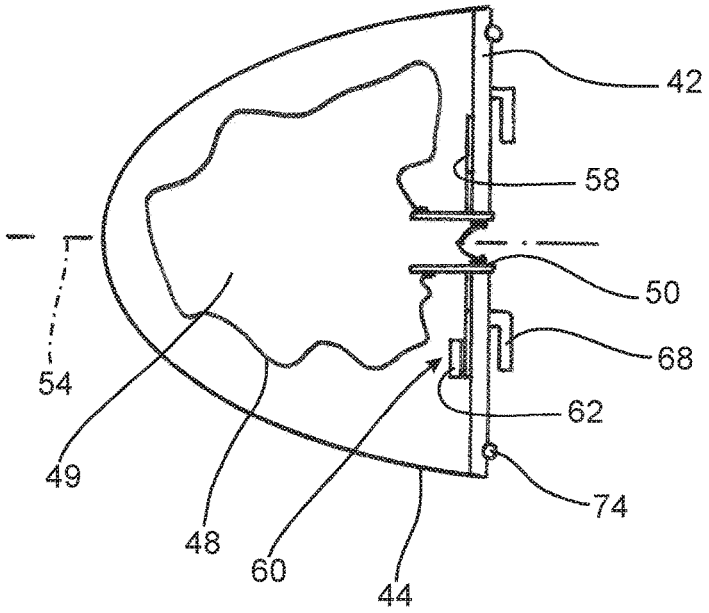
FIG. 4: is a sectional representation of the supply tank of a second working example, as viewed along a sectional plane such as IV-IV in FIG. 2 and FIG. 5: is a partial sectional image, as viewed along the sectional view such as V-V in FIG. 3 for an end piece of the main unit for the second working example.

The second coupling member 50 is formed such that it is self-sealing, unless the first coupling member 52 is located in the second coupling member 50. It is thereby assured that the interior space of the bag 48 is sealed when the coupling 50, 52 is open and thus is separated, as it is shown in FIG. 1. FIG. 4 shows a respective self-locking valve. Preferably, the self-locking valve simultaneously provides a seal between the two coupling members 50, 52, when the coupling 50, 52 is closed.

A gasket 74 is arranged at the ink container 40. It is kept at the outer rim of the container wall 42 and thus in close proximity to the rim of the cap 44. It is of annular shape. Alternatively, it is arranged at the main unit 20.

Three hooks protrude from the ink container 40. They are located within the gasket 74. Together with appropriately formed pockets, they form mechanical coupling device 66, 68. The pockets are also located within the gasket 74. The pockets represent a working example for a first coupling means 66, the hooks are a working example for the second coupling means 68 of the mechanical coupling device 66, 68. Other embodiments of the coupling means are also possible. Thus, a coupling means may for example be configured as a male thread, the other one may be configured as a female thread. It is also possible to form the coupling device 66, 68 as a bayonet joint or a snap-in connection. A kinematic inverse mechanism is also possible.

In another embodiment, in a kinematic inverse mechanism, the hooks, which form the second coupling means 68 of the mechanical coupling device 66, 68 in the first working example shown, are arranged at an end wall 64 opposite to the container wall 42 of the main unit 20, and the pocket-shaped first coupling means 68 is formed at the container wall 42.

It is possible for the first coupling means 66 to be formed at the container wall 42 and to be formed as being non-airtight. The first coupling member 52 may thus as well undertake the function of the hole 46. When the coupling means 66, 68 are formed in an airtight manner, they may be arranged inside or outside of the circumference of the gasket 74.

When the coupling means 66, 68 are arranged outside the circumference of the gasket 74, it is required that they are formed in an airtight manner, e.g. having airtight pockets. This is not required with an arrangement inside the gasket 74. Outside the gasket, the housing of the supply tank 40 is airtight.

As it is shown in the FIGS. 1 and 5, a pneumatic pump 70 or another suitable air pressure generator is located within the main unit 20. Devices, such as e.g. utilized in portable blood pressure measuring apparatuses, are utilized. The pneumatic pump 70 is controlled by the controller 32, and it is connected to it. An outlet side compressed-air line 76, which is configured as a tube, enters into an air passage 72, which is located in the end wall 64 of the main unit 20. The air passage 72 is arranged inside the gasket 74. It will over-pressurize the interstice between the end wall 64 and the container wall 42, as when the pneumatic pump 70 is turned off. This interstice is in communication with the interior space of the ink container 40 through the hole 46 or an equivalent passage, e.g. pockets. Thus, overpressure is also applied to the interior space. Due to this overpressure, the bag 48 is compressed, thereby over-pressurizing the ink 49.

The ink line 56 connects the first coupling member 52 with a printing mechanism 78. Said printing mechanism is associated to the outlet openings 26. The printing mechanism 78, e.g. has at least one valve, not shown herein, which e.g. controls the pressurizing procedure and is a conventional component of an ink printer, or is continuously providing ink droplets. In this way, the pressurizing procedure is made possible. Other printing methods are also possible. Due to overpressure in the ink container 40, it is assured for the ink 49 to be able to be conveyed at least into the main unit 20, without the requirement for the ink 49 to be aspirated or to be otherwise conveyed. Advantageously, the overpressure is sufficient for the pressurizing procedure. In this way, additional augmentation of pressure may be omitted.

The compressed-air line 76 is associated to a first pressure sensor 80. For example, it is attached thereto. In general, it is arranged such that the pressure value of the air pressure generated by the pneumatic pump 70 within the main unit 20 will be acquired. The first pressure sensor 80 is connected to the controller 32. It outputs an air pressure signal to the controller 32.

The ink line 56 is associated to a second pressure sensor 82. For example, it is attached thereto. In general, it is arranged such that, within the main unit 20, the pressure value of the fluid from the bag 48 will be acquired. The second pressure sensor 82 is connected to the controller 32. It outputs an ink pressure signal to the controller 32.

The controller 32 processes the two pressure signals. They will be compared to each other continuously or at specified intervals. A signal "ink empty" will be emitted, if the ink pressure signal declines by more than 2%, eventually more than 3%, preferably more than 10% in relation to the air pressure signal. A display 84, which is arranged at the main unit 20, emits an appropriate signal, for example a light signal. Other displays are possible. If the level of fluid actually stored in the bag 48 is relatively low, so that it will not be sufficient for a pressurizing procedure, this will be displayed. The pressurizing procedure may then be locked.

The described arrangement consisting of the gasket 74, the fluid coupling comprising the coupling members 50, 52 and the mechanical coupling comprising the coupling means 60, 68 form a coupling area. The supply tank 40 is releasably connected to the write head 20 via the coupling area.

Preferably, the container wall 42 and the end wall 64 are limited towards the exterior by a circle, which is centrically to the axis 54. This is represented in the working examples. Preferably, the mechanical coupling is operated by a rotational movement across a certain angular range, for example 10 to 40°. It is preferably formed as a bayonet joint, such as it is indicated in the working example.

Figure 2:
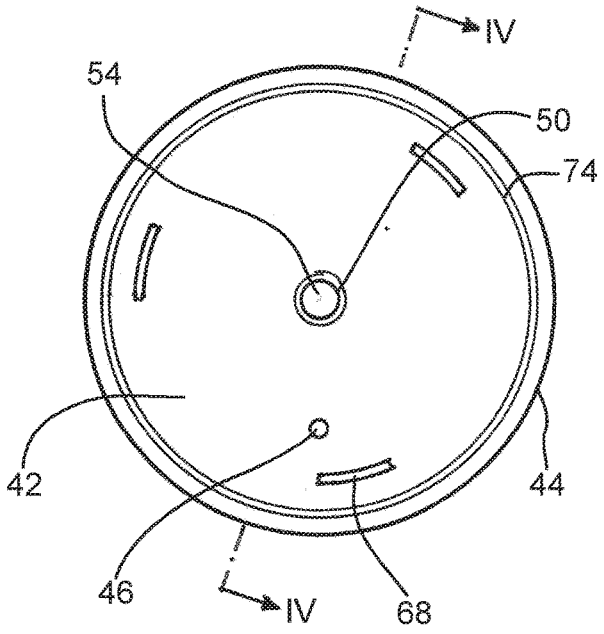
FIG. 2: is a view in an axial direction, as viewed from the parting plane in FIG. 1, onto the supply tank.
Figure 3:
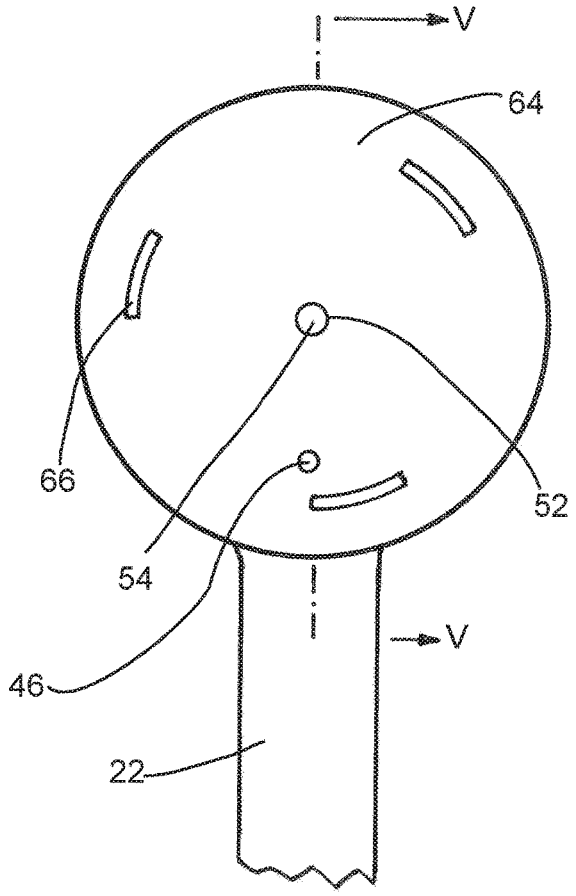
FIG. 3: is an axial view, as viewed from the parting plane and in a perspective opposite to FIG. 2, onto the main unit.

According to the FIGS. 4 and 5, the second working example comprises all features of the first working example according to the FIGS. 1 to 3. The second working example differs from the first working example by the following additional elements, which are set forth in the following four paragraphs:

At the end wall 64 of the main unit 20, a circular-shaped first antenna 36 is arranged. It is connected to a basic unit 34, which is arranged in the main unit 20 and is connected to the controller 32. A circular-shaped second antenna 58 of a transponder 60 is attached to the inner surface of the container wall 42. Moreover, a control unit 62 is associated to this transponder 60. The transponder 60 cooperates with the basic unit 34. It is designed for and adjusted to said basic unit 34. Such cooperating units consisting of a basic unit 34 and a transponder 60 are known from prior art, reference is made to U.S. Pat. Nos. 7,520,429 B2; 4,862,160 A and US 2009/016049 A1. Such units of a basic unit 34 and a transponder 60 are often referred to as a RFID system. The basic unit 34 not only reads but also sends information to the transponder 60 and therefrom receives responses. It is able to both send and receive. In the present case, the transponder 60 is a so-called passive transponder 60, it has no dedicated voltage supply. It is as well supplied with power by the basic unit 34. It is suitable for the antennas 36, 58 of both units to preferably be coaxial and to essentially have the same radial extension. They should be coupled as good as possible. This is represented in the figures.

In the control unit 62, the data regarding the ink 49 in the bag 48 are stored, said data including expiration date of the ink 49 or other fluid, respectively, its type, composition, initial amount and actual amount or amount of ink 49 withdrawn, respectively. Other features may be stored. When the respective amount of ink 49 is known, it is possible for different ink containers 40 to be operated, i.e. to replace them while being operated. This, for example, is required if printing with another color is desired. The RFID systems are standardize according to ISO-18000-1. This standard will be referred to.

Instructions are stored in the controller 32 and/or in the basic unit 34, to which the data contained in the control unit 62 may be compared and processed with. If, for example, the expiration date of the ink 49 has passed, printing operation is disabled, instead, a respective message, eventually a red flashing display light, will be activated. In this respect, the other data are also processed or utilized, respectively. In this respect, reference is made to the three EP patent documents and the WO publication already mentioned above.

If, in the working example shown, the antennas 36, 58 are each configured and represented as an annular disc, this is to be understood as being non-limiting. The antennas 36, 58 may also have other shapes, they may, for example, form a polygon, or may be of oval or star shape. In this context, the only crucial point is that a sufficiently large interior space is left free, so that a coupling member 50 or 52, respectively, may be arranged therein.

The ink jet printer for the labelling of goods has a write head 20, comprising a) at least one outlet opening 26 for ink droplets, b) a printing mechanism 78 connected to said outlet opening 26, c) a pneumatic pump 70 and d) an electrical control 32. It has at least one supply tank 40 for fluid flowing through the outlet opening 26. The supply tank 40 is releasably connected to the write head 20 in a coupling area. In the write head 20, a first pressure sensor 80 is arranged at the compressed-air line 76, which detects the air pressure in the compressed-air line 76 and outputs an air pressure signal to the controller 32. A second pressure sensor 82 is arranged at the ink line 56, which detects the pressure in the ink line 56 and emits an ink pressure signal to the controller 32. Said controller outputs a signal "ink empty", if the ink pressure signal declines by more than 10% in relation to the air pressure signal.

Terms, such as essentially, preferably and the like as well as details which are likely to be understood as being imprecise are to be understood in that a deviation by plus minus 5%, preferably plus minus 2% and especially, plus minus 1% from the regular value is possible.

LIST OF REFERENCE NUMBERS

20 main unit
22 handle
24 frontal surface
26 outlet opening
28 arrow
30 voltage supply
32 controller
34 basic unit
36 circular-shaped first antenna
38 release button
40 supply tank
42 container wall
44 cap
46 hole
48 bag
49 ink, fluid
50 second coupling member
52 first coupling member
54 axis
56 ink line
58 circular-shaped second antenna
60 transponder
62 control unit
64 end wall
66 first coupling means
68 second coupling means
70 pneumatic pump, air pressure generator
72 air passage
74 gasket
76 compressed-air line
78 printing mechanism
80 first pressure sensor
82 second pressure sensor
84 display

What is claimed is:

1. An ink jet printer for the labelling of goods with a write head (20) comprising a) at least one outlet opening (26) for ink droplets at a frontal surface (24), b) a printing mechanism (78) connected to said outlet opening (26), c) a pneumatic pump (70) and d) an electrical control (32), and having at least one supply tank (40) for fluid flowing through the outlet opening (26), such as e.g. ink (49), pigment or solvent, wherein the supply tank (40) is releasably connected to the write head (20) in a coupling area, and having a housing as well as a foldable bag (48) located in said housing, in which bag fluid is accommodated, and which is connected to the printing mechanism (78) via an ink line (56), which is passed across the coupling area, the pneumatic pump (70) is connected to the space between the housing and the bag (48) via a compressed-air line (76), thus over-pressurizing said space, characterized in that, in the write head (20), the compressed-air line (76) is associated to a first pressure sensor (80), which detects the air pressure in the compressed-air line (76) and in the space between the bag (48) and the housing and outputs an air pressure signal to the controller (32), in that, in the write head (20), the ink line (56) is associated to a second pressure sensor (82), which detects the pressure in the ink line (56) and outputs an ink pressure signal to the controller (32), and in that the controller (32) outputs a signal "ink empty ", if the ink pressure signal declines by more than 5% in relation to the air pressure signal.

2. The ink jet printer according to claim 1, characterized in that the first pressure sensor is arranged in an area of a tube of the compressed-air line (76) that is freely accessible and/or in that the second pressure sensor is arranged in a freely accessible area of a tube of the ink line (56).

3. The ink jet printer according to claim 1, characterized in that in normal operation, wherein sufficient ink (49) is present in the bag (48), the ratio of the air pressure signal to the ink pressure signal is determined and is stored as a normal value in a storage of the controller (32).

4. The ink jet printer according to claim 1, characterized in that in the controller (32) the emptiness signal "ink empty" will be output not before the ink pressure signal, during a time span larger than zero seconds, has declined in relation to the air pressure signal.

5. The ink jet printer according to claim 4, wherein the time span is at least 0.5 seconds.

6. The ink jet printer according to claim 1, characterized in that the air pressure signal in the controller (32) is constantly being acquired, and in that an error signal will be output if the air pressure signal deviates from a conventional value by at least 5%, especially has declined during a span of time greater than zero seconds, in relation to the conventional value.

7. The ink jet printer according to claim 6, wherein the span of time is at least 0.5 seconds.

8. The ink jet printer according to claim 1, characterized in that the coupling area comprises an exterior gasket, in that the housing of the supply tank (40) comprises a container wall (42), at least part of which is located inside the gasket and in that this part has an opening, through which the space between the bag (48) and the housing of the supply tank (40) is accessible.

* * * * *